United States Patent [19]

Sauerteig et al.

[11] Patent Number: 4,571,378

[45] Date of Patent: Feb. 18, 1986

[54] COLOR PHOTOGRAPHIC RECORDING MATERIAL AND DEVELOPMENT PROCESS

[75] Inventors: Wolfgang Sauerteig; Erwin Ranz; Heinz Schütz, all of Leverkusen, Fed. Rep. of Germany

[73] Assignee: Agfa-Gevaert Aktiengesellschaft, Leverkusen, Fed. Rep. of Germany

[21] Appl. No.: 680,154

[22] Filed: Dec. 10, 1984

[30] Foreign Application Priority Data

Dec. 23, 1983 [DE] Fed. Rep. of Germany ..... 3346621

[51] Int. Cl.[4] ..... G03C 1/46

[52] U.S. Cl. ..... 430/505; 430/382; 430/506; 430/509; 430/544; 430/957

[58] Field of Search ..... 430/505, 506, 509, 957, 430/544, 382

[56] References Cited

U.S. PATENT DOCUMENTS

| | | | |
|---|---|---|---|
| 4,170,479 | 10/1979 | Usami | 430/506 |
| 4,183,752 | 1/1980 | Kuffner et al. | 430/957 |
| 4,315,070 | 2/1982 | Ranz et al. | 430/505 |
| 4,355,100 | 10/1982 | Sugita et al. | 430/505 |
| 4,500,633 | 2/1985 | Menjo et al. | 430/505 |

*Primary Examiner*—J. Travis Brown

*Attorney, Agent, or Firm*—Connolly and Hutz

[57] ABSTRACT

Improved photographic recording materials containing at least one silver halide emulsion layer with comparatively high sensitivity and at least one silver halide emulsion layer with comparatively low sensitivity. Color couplers and DIR compounds of differing reactivities are associated with these layers.

7 Claims, No Drawings

COLOR PHOTOGRAPHIC RECORDING MATERIAL AND DEVELOPMENT PROCESS

This invention relates to a colour photographic recording material containing at least one silver halide emulsion layer with comparatively high sensitivity and one silver halide emulsion layer with comparatively low sensitivity, both being sensitive to the same spectral region, these layers having colour couplers and DIR compounds associated therewith. The present invention also relates to a process for the development of an exposed photographic recording material.

It is known that the sensitometric properties of a recording material may be controlled by compounds from which diffusible substances capable of inhibiting the development of silver halide are released in the course of development. Such compounds include the DIR couplers disclosed in GB No. 953,454 which carry, in the coupling position, a substituent which is split off in the process of coupling to release a diffusible compound which inhibits the development of the silver halide. DIR couplers may be used to improve the colour graininess and exert a controlled influence on the interimage effect.

Similar effects may also be obtained with compounds which do not produce a permanent dye; see U.S. Pat. No. 3,632,345 and DE-OS No. 2,359,295. All compounds which react with colour developer oxidation products to release diffusible organic substances inhibiting the development of the silver halide will hereinafter be referred to as "DIR compounds".

U.S. Pat. No. 3,620,747 and DE-OS No. 2,322,165 disclose photographic materials having two silver halide emulsion layers sensitive to the same spectral region, but differing in the degree of sensitivity, both layers containing colour couplers, while the less sensitive layer in addition contains a DIR compound. DE-OS No. 2,509,722 and GB-PS No. 1,536,341 disclose the combination of at least two DIR compounds differing in reactivity. According to these references, a silver halide emulsion layer may be sub-divided into two partial layers differing in sensitivity. The more sensitive silver halide partial layer may contain the more highly reactive DIR compound and the less sensitive silver halide partial layer the less reactive DIR compound or conversely. The use of DIR compounds in more highly sensitive and less sensitive partial layers has also been mentioned in DE-OS No. 2,600,524 and U.S. Pat. No. 4,170,479. Photographic recording materials containing DIR compounds having low reactivity, which are suitable in particular for being mixed with more highly reactive DIR compounds, have been disclosed in DE-OS No. 2,707,489 and U.S. Pat. No. 4,183,752. In these materials, a coarse grained, highly sensitive layer containing a sub-equivalent amount of colour coupler may be combined with a less sensitive layer to form a so-called "double layer combination". For obtaining improved sensitometric properties, the DIR compounds may be added to one of the two layers or to both layers, but addition to the lower, fine grained layer of a double layer combination is preferred. DIR compounds having exceptionally high reactivity are disclosed in DE-OS No. 2,853,362 and U.S. Pat. No. 4,315,040. According to European Patent Application No. 00 70 183, DIR compounds are preferably contained in the less sensitive partial layers of a double layer combination. According to EP No. 00 86 654, a DIR compound carrying a so-called "timing group" is introduced into a highly sensitive layer and a DIR compound without timing group is introduced into a less sensitive layer.

In double layer arrangements, the use of DIR compounds in the more sensitive partial layers is very liable to result in unacceptable losses in sensitivity. At the same time, the use of DIR compounds in the more sensitive partial layers is desired for the purpose of improving the colour graininess.

It is an object of the present invention to improve the sensitometric properties of colour recording materials. In particular, the colour graininess of such recording materials is also to be improved in the region of low colour density without impairing the sensitivity.

A photographic recording material comprising at least one comparatively highly sensitive silver halide emulsion layer (I) and a comparatively less sensitive silver halide emulsion layer (II), both being sensitive to the same spectral region, has now been found, in which layers (I) and (II) have DIR compounds of differing reactivities and colour couplers associated therewith. According to the present invention, the ratio $k_{Ku}/k_{DIR}$ of the effective reaction velocity constants of colour coupler $k_{Ku}$ and of DIR compounds $k_{DIR}$ is greater in layer (I) than in layer (II).

The effective reaction velocity constants mentioned above refer to the reaction with developer oxidation product. This oxidation product is the result of oxidiation of p-phenylene diamines conventionally used as colour developers by the silver halide.

The determination of reaction velocity constants has been described, for example, by J. Eggers in "Mitteilungen aus den Forschungslaboratorien der Agfa", Leverkusen/Munich, Volume III, 1961, pages 81 et seq. Since it has been shown that the reaction velocity constant of a DIR compound is influenced by the surrounding medium, the effective reaction velocity constant is used according to the present invention. This constant takes into account the surrounding medium, for example the use of an oil-former. The effective reaction velocity constant may be determined electrochemically by the method disclosed in DE-OS No. 2,853,632 and U.S. Pat. No. 4,315,070, according to which the effective reaction velocity constant $k_{eff}$ is expressed in terms of $[1 \times mol^{-1} \times sec.^{-1}]$.

The ratio of effective reaction velocity constants in the more sensitive layer (I) is preferably from 2:1 to 20:1 and the ratio of reaction velocity constants of the colour couplers and DIR compounds of the less sensitive layer (II) is preferably from 0.03:1 to 6:1. Each DIR compound and coupler is always associated with a particular silver halide emulsion layer. Its subsequent reaction in the course of photographic development is therefore controlled by the development of the associated silver halide emulsion layer. In the simplest case, the colour coupler and DIR compound are present in the silver halide emulsion layer, but they may also be present in an adjacent layer. In some cases, however, the colour coupler is only enabled to diffuse into the recording material in the course of development.

In a preferred embodiment, the photographic material itself contains the conventional colour couplers which are capable of reacting with the oxidation product of the developers, generally of p-phenylene diamines, to form dyes.

Thus, the red-sensitive layer, for example, may contain a non-diffusible colour coupler to produce the cyan partial colour image, generally a coupler of the phenol or α-naphthol series. The green-sensitive layer may, for example, contain at least one non-diffusible colour coupler to produce the magenta partial colour image, generally a colour coupler of the 5-pyrazolone series; or the layer may, for example, contain a non-diffusible colour coupler to produce the yellow partial colour image, generally a colour coupler having an open-chain ketomethylene group. The colour couplers may be, for example, 6-, 4- or 2-equivalent couplers, including so-called "white couplers" which do not give rise to a dye when they react with colour developer oxidation products. Suitable couplers have been disclosed, for example, in the publications, "Farbkuppler" by W. Pelz in "Mitteilungen aus den Forschungslaboratorien der Agfa, Leverkusen/München", Volume III, page 111 (1961), K. Venkataraman in "The Chemistry of Synthetic Dyes", Volume 4, 341 to 387, Academic Press (1971) and T. H. James, "The Theory of the Photographic Process", 4th Edition, pages 353 to 362, and the Journal "Research Disclosure", No. 17643 of December 1978, Section VII, Published by Industrial Opportunities Ltd., Homewell Havant, Hampshire, PO9 1EF, Great Britain.

The DIR compounds to be used according to the present invention are substances which are capable of reacting with the oxidized colour developer to release substances which inhibit the development of the adjacent silver halide. The released inhibitory substances are preferably mercapto compounds, e.g. 1-phenyl-5-mercaptotetrazole. In the DIR compounds to be used according to the present invention, the inhibitory substances are released directly by the reaction of the DIR compound with the developer oxidation product.

Particularly suitable DIR compounds for use in the comparatively sensitive layer (I) have been disclosed, for example, in DE-OS No. 2,707,489 and correspond to the following general formula:

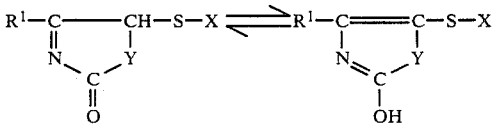

wherein $R^1$ represents a substituted or unsubstituted hydrocarbyl group;

Y represents S or $NR^2$ wherein $R^2$ represents hydrogen, a substituted or unsubstituted hydrocarbyl group, a heterocyclic group attached through a ring carbon atom or an electron-attracting substituent; and X represents an aliphatic group, an aromatic group or in particular a heterocyclic group which is released together with the sulphur atom of the thioether bridge to form a diffusible mercapto compound which inhibits the development of the silver halide.

The particular compounds of the thiazole series and imidazole series mentioned in DE-OS No. 2,707,489 and U.S. Pat. No. 4,183,752 under 1 to 30 are particularly suitable.

Exceptionally suitable compounds for use in sensitive layer (I) according to the present invention are given in Table 1 below. The $k_{eff}$ values refer to a solution in the solvent indicated:

TABLE 1

| NO. | Compound | $k_{eff}$ |
|---|---|---|
| 1.1 | 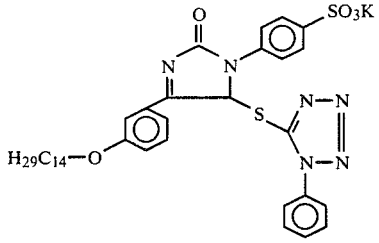 | 1,000 in water |
| 1.2 | 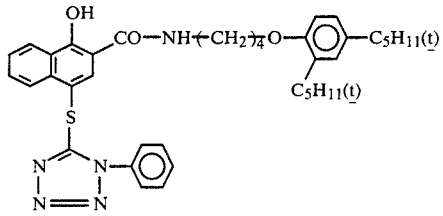 | 500 in tricresyl phosphate |

DIR compounds which are particularly suitable for use in the less sensitive layer (II) have been disclosed, for example, in DE-OS No. 2,853,362 and U.S. Pat. Nos. 3,227,554 and 4,315,070. Particularly preferred DIR compounds of this type are shown in Table 2 below ($k_{eff}$ values refer to the solution in the given solvent):

TABLE 2

| No. | Compound | $k_{eff}$ |
|---|---|---|
| 2.1 | 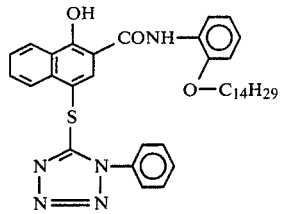 | 12,000 in tricresyl phosphate |
| 2.2 | 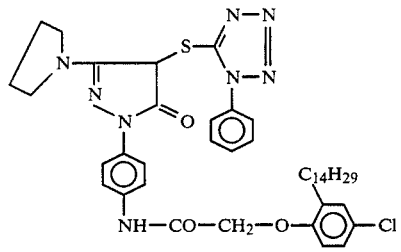 | 3,000 in tricresyl phosphate |
| 2.3 | 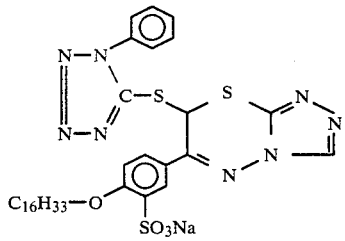 | 3,000 in water |
| 2.4 | | 50,000 in water |

TABLE 2-continued

| No. | Compound | $k_{eff}$ |
|---|---|---|
| | 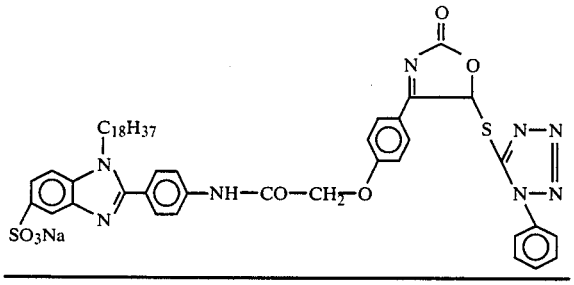 | |

The colour couplers and DIR compounds to be used according to the present invention may be incorporated in the materials according to the present invention by the well known conventional methods. If the compounds are soluble in water or alkalis, they may be added in the form of aqueous solutions, optionally with the addition of water-miscible organic solvents, such as ethanol, acetone or dimethyl formamide. If the colour couplers and DIR compounds are insoluble in water or alkalis, they may be incorporated in the form of dispersions in known manner. For example, a solution of these compounds in a low boiling organic solvent may be mixed directly with the silver halide emulsion or it may first be mixed with an aqueous gelatine solution, the organic solvent being subsequently removed, and the resulting dispersion of the particular compound may then be mixed with the silver halide emulsion. So-called "oil-formers" may also be added if desired, these being generally relatively high boiling organic compounds forming oily droplets in which the colour couplers and DIR compounds to be dispersed are incorporated. Information on this subject may be found, for example, in U.S. Pat. Nos. 2,322,027; 2,533,514; 3,689,271, 3,764,336 and 3,765,897.

The recording materials according to the present invention contain at least one silver halide emulsion layer unit for recording blue, green and red light.

The red-sensitive silver halide emulsion layer unit is normally arranged closer to the layer support than the green-sensitive silver halide emulsion layer unit, which in turn is arranged closer to the layer support than the blue-sensitive unit. At least one silver halide emulsion layer unit consists of at least two partial layers differing in sensitivity. In a preferred embodiment, at least one of the units for the recording of green, red or blue light consists of at least two partial layers. One particularly preferred arrangement of this type is composed of the following layers:

blue-sensitive layer(s)
yellow filter
more highly sensitive green-sensitive layer
less sensitive green-sensitive layer
more highly sensitive red-sensitive layer
less sensitive red-sensitive layer support.

Intermediate layers are not indicated here, but may, of course, be present.

Partial layers differing in spectral sensitivity may, if desired, be combined according to the degree of sensitivity (speed) thereof. According to a particularly preferred embodiment the following arrangement is made (not taking into account any intermediate layers):

blue-sensitive layer(s)
yellow filter layer
more highly sensitive green-sensitive layer
more highly sensitive red-sensitive layer
less sensitive green-sensitive layer
less sensitive red-sensitive layer support.

Combinationas having the ratio $k_{Ku}/k_{DIR}$ according to the present invention may be used in all but optionally only in one or two layer units.

The silver halide emulsions used may contain halide in the form of chloride, bromide, iodide or mixtures thereof. According to a preferred embodiment the halide content of at least one layer is composed of from 0 to 10 mol % of AgI, from 0 to 10 mol % of AgCl and from 0 to 100% of AgBr, the sum of these percentages amounting to 100%. In another embodiment, the halide content may consist predominantly of chloride. The silver halide grains may be, for example, cubical or octahedral or tabular.

The emulsions may be chemically sensitized. The conventional sensitizing agents may be used for chemically sensitizing the silver halide grains. Compounds containing sulphur are particularly preferred, e.g. allylisothiocyanate, allylthiourea or thiosulphates.

Reducing agents may also be used as chemical sensitizers, e.g. tin compounds described in Belgian Pat. Nos. 493,464 and 568,687, polyamines, such as diethylene triamine, or aminomethyl sulphinic acid derivatives, e.g. according to Belgian Pat. No. 547,323.

Noble metals and compounds of noble metals, such as gold, platinum, palladium, iridium, ruthenium or rhodium, are also suitable chemical sensitizers. This method of chemical sensitization has been described in the article by R. Koslowsky, Z. Wiss, Phot. 46, 65–72 (1951). The emulsions may also be sensitized with polyalkylene oxide derivatives, e.g. with a polyethylene oxide in the molecular weight range of from 1,000 to 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines or amides. These condensation products should have a molecular weight of at least 700, preferably more than 1,000. These sensitizers may, of course, be combined to produce particular effects, as described in Belgian Pat. No. 537,278 and in British Pat. No. 727,982. Further information may also be found in the above-mentioned Research Disclosure No. 17,643, Section III.

The emulsions may be optionally sensitized in known manner e.g. with the conventional polymethine dyes, such as neutrocyanines, basic or acid carbocyanines, rhodacyanines, hemicyanines, styryl dyes, oxonols or the like. Sensitizers of this type have been described by F. M. Hammer in "The Cyanine Dyes and related Compounds", (1964). Particular reference should be made in this connection to Ullmanns Enzyklopädie der technischen Chemie, 4th Edition, Volume 18, pages 431 et seq and the above-mentioned Research Disclosure No. 17,643, Section IV.

Conventional anti-fogging agents and stabilizers may be used in addition to the anti-fogging agents which are to be used according to the present invention.

Azaindenes are particularly suitable stabilizers, especially tetra- and penta-azaindenes and particularly those which are substituted with hydroxyl or amino groups. Compounds of this type have been described, for example, in the article by Birr, Z. Wiss. Phot. 47, 1952, pages 2–58. Other suitable stabilizers and anti-fogging agents are indicated in the above-mentioned Research Disclosure No. 17643, Section IV.

The conventional layer supports may be used for the materials according to the present invention, e.g. cellulose ester supports, such as cellulose acetate, and supports of polyesters. Paper supports are also suitable and these may be coated, e.g. with polyolefins, in particular with polyethylene or polypropylene. Further information on this may be found in the above-mentioned Research Disclosure No. 17,643, Section XVII.

The conventional hydrophilic film-forming agents may be used as protective colloids or binders for the layers of the recording material, e.g. proteins, in particular gelatine, alginic acid or its derivatives, such as esters, amides or salts, cellulose derivatives, such as carboxymethyl cellulose and cellulose sulphates, starches or derivatives thereof or hydrophilic synthetic binders, such as polyvinyl alcohol, partially saponfied polyvinyl acetate, polyvinyl pyrrolidone, and others. The hydrophilic binders in the layers may be mixed with other synthetic binders in the form of solutions or dispersions, such as homo- or co-polymers of acrylic or methacrylic acid or derivatives thereof, such as the esters, amides or nitriles, or vinyl polymers, such as vinyl esters or vinyl ethers. Reference to the above-mentioned Research Disclosure 17,643, Section IX may also be made for suitable binders.

The layers of photographic material may be hardened in the conventional manner, for example with epoxide-type hardeners, heterocyclic ethylene imine hardeners or acryloyl hardeners. The layers may also be hardened by the process according to Germany Offenlegungsschrift No. 2,218,009 to produce colour photographic materials suitable for high temperature processing. The photographic layers or colour photographic multi-layered materials may also be hardened with hardeners of the diazine, triazine or 1,2-dihydroquinoline series or with vinyl sulphone hardeners. Other suitable hardeners have been disclosed in German Offenlegungsschrift Nos. 2,439,551; 2,225,230 and 2,317,672 and in the above-mentioned Research Disclosure 17,643, Section XI.

Other suitable additives are indicated in Research Disclosure 17,643 and in "Product Licensing Index" of December 1971, pages 107–110.

Suitable colour developer substances for the material according to the present invention include in particular those of the p-phenylene diamine series, e.g. 4-amino-N,N-diethyl-aniline hydrochloride; 4-amino-3-methyl-N-ethyl-N-β-(methane sulphonamido)-ethyl aniline sulphate hydrate; 4-amino-3-methyl-N-ethyl-N-β-hydroxyethyl aniline sulphate; 4-amino-N-ethyl-N-(2-methoxyethyl)-m-toluidine-di-p-toluene sulphonic acid and N-ethyl-N-β-hydroxyethyl-p-phenylene diamine.

Other suitable colour developers have been described, for example, in J. Amer. Chem. Soc. 73, 3100 (1951) and in G. Haist, Modern Photographic Processing, 1979, John Wiley and Sons, New York, Pages 545 et seq.

After colour development, the material is bleached and fixed in the conventional manner. Bleaching and fixing may be carried out separately or together. The conventional compounds may be used as bleaching agents, e.g. $Fe^{3+}$ salts and $Fe^{3+}$ complex salts, such as ferricyanides, dichromates, water-soluble cobalt complexes, etc. Iron-III complexes of aminopolycarboxylic acids are particularly preferred, in particular, e.g. ethylene diaminotetraacetic acid, nitrilotriacetic acid, iminodiacetic acid, N-hydroxyethyl ethylene diaminotriacetic acid, alkyl iminodicarboxylic acids and corresponding phosphonic acids. Persulphates are also suitable bleaching agents.

EXAMPLES

The colour couplers mentioned in the Examples correspond to the following structures:

| No. | Compound | $k_{eff}$ |
|---|---|---|
| A | 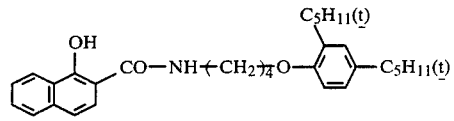 | 7,000 |
| B | 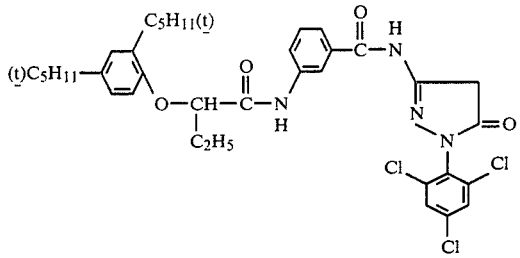 | 10,000 |

EXAMPLE 1

The layers indicated below are applied in succession to a cellulose triacetate support carrying an antihalation layer and an adhesive layer. The quantities indicated refer in each case to $Im^2$. The quantity of silver applied is given in terms of the equimolar quantities of silver nitrate.

1. Red-sensitive layer with low sensitivity.

The layer contains a red-sensitive silver iodobromide emulsion having comparatively low sensitivity (5 mol % silver iodide), 600 mg of cyan coupler A, 30 mg of DIR compound 2.1 and a masking coupler. Colour coupler A is dispersed in 600 mg of di-n-butyl phthalate, while DIR compound 2.1 is dispersed in 60 mg of tricresyl phosphate as oil-former. Silver application: 3.5 g.

2. Red-sensitive layer with high sensitivity.

The layer contains a highly sensitive red-sensitive silver iodobromide emulsion having a silver iodide content of 8 mol % and containing 200 mg of the cyan coupler A indicated under 1. in 200 mg of di-n-butyl phthalate, as well as a DIR compound as shown in Table 3. Silver application: 3.0 g.

3. Intermediate layer.

The intermediate layer contains 0.7 g of gelatine and, dispersed therein, 0.09 g of a compound corresponding to the following formula acting as acceptor for developer oxidation products:

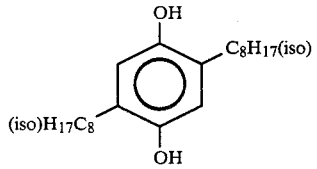

4. Green-sensitive layer with low sensitivity.

The layer contains a green-sensitive silver iodobromide emulsion having comparatively low sensitivity (6 mol % of silver iodide) and a magenta coupler of the pyrazolone series, a DIR compound and a yellow masking coupler. Silver application: 2.2 g.

5. Green-sensitive layer with high sensitivity.

This layer contains a highly sensitive green-sensitive silver iodobromide emulsion (10 Mol % silver iodide) and a magenta coupler of the pyrazolone series dispersed therein.

6. Intermediate layer

The intermediate layer contains 0.5 g of gelatine and, dispersed therein, the acceptor for developer oxidation products indicated in the description of layer 3.

7. Yellow filter layer

The yellow filter layer contains colloidal silver. Density: 0.7.

8. Blue-sensitive layer with low sensitivity.

This layer contains a blue-sensitive silver iodobromide emulsion having comparatively low sensitivity (5 mol% of silver iodide) and, dispersed in this emulsion, a mixture of yellow couplers of the benzoyl acetanilide series.

9. Blue-sensitive layer with high sensitivity.

This layer contains a highly sensitive blue-sensitive layer containing 6 mol % of silver iodide and a mixture of the yellow couplers mentioned in the description of layer 8.

10. UV absorbent layer

This layer contains 0.8 g of a UV absorbent of the benzotriazole series dispersed in gelatine.

11. Covering layer.

The covering layer consists of gelatine.

Samples of materials built-up as described above are exposed behind a step wedge and subjected to the colour negative process described in British Journal of Photography, 1974, page 597. The results obtained are indicated in Table 3.

TABLE 3

| | Arrangement of red-sensitive layers | | |
|---|---|---|---|
| | Arrangement I, comparison | Arrangement II, comparison | Arrangement III, invention |
| Layer 1 | | | |
| Coupler | A | A | A |
| $k_{eff}$ | 7000 | 7000 | 7000 |
| DIR Compound | 2.1 | 2.1 | 2.1 |
| $k_{eff}$ | 12000 | 12000 | 12000 |
| Layer 2 | | | |
| Coupler | A | A | A |
| $k_{eff}$ | 7000 | 7000 | 7000 |
| DIR Compound | — | 2.1:30 mg/m$^2$ in 60 mg/m$^2$ tricresyl-phosphate | 1.1:40 mg/m$^2$ introduced as aqueous solution |
| $k_{eff}$ | | 12000 | 1000 |
| Red sensitivity | 24.0 DIN | 23.0 DIN | 24.1 DIN |
| Graininess at density | | | |
| 0.5 above fog | 1.8 | 1.5 | 1.5 |
| 1.0 above fog | 1.7 | 1.5 | 1.5 |
| 1.5 above fog | 1.6 | 1.4 | 1.4 |

Red sensitivity:

The sensitivity is given in DIN; an increase by 3.0 units corresponds to a doubling of the sensitivity.

Graininess:

The graininess is given in the form of the $\delta_D$ value$\times 10^2$. It is obtained from the fluctuations in density recorded when scanning a very long trace of the material. For methods of measurement, see Ullmann Encyclopädie der technischen Chemie, 4th Edition, Verlag Chemie, Weinheim 1979, page 412 et seq.

Table 3 shows that when a DIR compound is used only in the less sensitive layer, the sensitivity obtained is satisfactory, but the graininess is only moderate. If the reactive DIR compound 2.1 is also used in the highly sensitive layer, an improvement in the graininess is obtained, but at the expense of a significant loss in sensitivity (arrangement II). It is only when a suitable DIR compound of comparatively low reactivity is used that an improvement in graininess is obtained without loss of sensitivity (arrangement III invention).

EXAMPLE 2

A colour photographic recording material having partial layers arranged according to sensitivity is prepared. Except for the alterations indicated below, this material has substantially the same arrangement as the material described in the example of DE-OS No. 2,704,797 and U.S. Pat. No. 4,173,479. In this arrangement, the following layers are applied to a support in the sequence given.

1. Red-sensitive layer with low sensitivity containing a cyan coupler
2. a gelatine intermediate layer
3. a green-sensitive layer with low sensitivity.

The layer contains a silver iodobromide emulsion with comparatively low sensitivity containing 7 mol % of silver iodide and sensitized to green. It also contains 1000 mg of colour coupler B dispersed in 1000 mg of tricresyl phosphate and 35 mg of DIR compound 2.2 dispersed in 35 mg of tricresyl phosphate. The silver application is 3.8 g.

4. A gelatine intermediate layer.
5. A highly sensitive red-sensitive layer.
6. A gelatine intermediate layer.
7. A highly sensitive green-sensitive layer.

The layer contains a highly sensitive silver iodobromide emulsion having an iodide content of 10 mol and sensitized to green. It also contains 250 mg of colour coupler B dispersed in 250 mg of tricresyl phosphate and may contain a DIR compound according to the particulars given in Table 4 below. The silver application is 2.2 g.

8. A gelatine intermediate layer.
9. A yellow filter layer of colloidal silver.
10. A blue-sensitive layer of low sensitivity containing a yellow coupler.
11. A highly sensitive blue-sensitive layer containing a yellow coupler.
12. A protective gelatine layer.

Samples of such materials are exposed behind a step wedge and subjected to the colour negative process described in the British Journal of Photography, 1974, page 597. The results shown in Table 4 are obtained.

TABLE 4

| | Arrangement of the green-sensitive layers | | |
|---|---|---|---|
| | Arrangement I, comparison | Arrangement II, comparison | Arrangement III, invention |
| Layer 3 | | | |
| Coupler | B | B | B |
| $k_{eff}$ | 10500 | 10500 | 10500 |
| DIR Compound | 2.2 | 2.2 | 2.2 |
| $k_{eff}$ | 3000 | 3000 | 3000 |
| Layer 7 | | | |
| Coupler | B | B | B |
| $k_{eff}$ | 10500 | 10500 | 10500 |
| DIR Compound | — | 2.2:35 mg/m$^2$ in 35 mg/m$^2$ of tricresyl | 1.1:35 mg/m$^2$ as aqueous solution |

TABLE 4-continued

| | Arrangement of the green-sensitive layers | | |
|---|---|---|---|
| | Arrangement I, comparison | Arrangement II, comparison | Arrangement III, invention |
| $k_{eff}$ | | phosphate 3000 | 1000 |
| Green sensitivity | 27.0 DIN | 25.5 DIN | 27.0 DIN |
| Graininess at density | | | |
| 0.5 above fog | 2.2 | 1.8 | 1.9 |
| 1.0 above fog | 2.1 | 1.8 | 1.8 |
| 1.5 above fog | 1.8 | 1.8 | 1.8 |

The sensitivity and graininess are as defined in Example 1. Table 4 shows that the improvements indicated in Example 1 are also obtained according to the present invention when partial layers differing in spectral sensitization are arranged according to their speed.

We claim:

1. Photographic recording material having at least one more sensitive silver halide emulsion layer (I) and one comparatively less sensitive silver halide emulsion layer (II), both being sensitive to the same spectral region, layers (I) and (II) having DIR compounds of differing reactivities and colour couplers associated therewith, wherein the ratio of the effective reaction velocity constant of the colour coupler to the effective reaction velocity constant of the DIR compound is higher in layer (I) than in layer (II) and wherein the sensitive silver halide emulsion layer (I) contains at least one DIR compound corresponding to the following general formula:

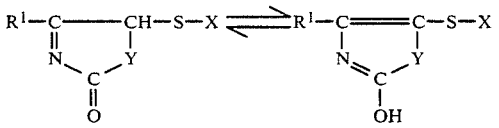

wherein $R^1$ represents an unsubstituted or substituted hydrocarbyl group;

Y represents S or $NR^2$ wherein $R^2$ represents hydrogen, an unsubstituted or substituted hydrocarbyl group, a heterocyclic group attached through a ring carbon atom or an electron-attracting substituent; and X represents an aliphatic group, an aromatic group or a heterocyclic group which, when split off with the sulphur atom of the thioether bridge, forms a diffusible mercapto compound which inhibits the development of the silver halide.

2. Photographic recording material according to claim 1, characterised in that the ratio of effective reaction velocity constants in layer (I) is from 2:1 to 20:1.

3. Photographic colour recording material according to claim 1, characterised in that the ratio of effective reaction velocity constants in layer (II) is from 0.03:1 to 6:1.

4. Photographic colour recording material according to claim 1, characterised in that the coupler and DIR compound are contained in the silver halide emulsion layer with which they are associated.

5. Process for the production of a photographic image by development of an exposed recording material having at least one comparatively sensitive silver halide emulsion layer (I) and a comparatively less sensitive silver halide emulsion layer (II), both being sensitive in the same region of the spectrum, characterised in that colour couplers and DIR compounds are associated with layers (I) and (II) in the process of development, the ratio of the effective reaction velocity constants of the colour coupler and of the DIR compound in association with layer (I) is greater than that of the colour coupler and DIR compound associated with layer (II).

6. Process according to claim 5, characterised in that at least one colour coupler is contained in the colour developer used for development.

7. Process according to claim 5, characterised in that the ratio of the effective reaction velocity constants of colour coupler and DIR compound associated with layer (I) is from 2:1 to 20:1 and that of the colour coupler and DIR compound associated with layer (II) is from 0.03:1 to 6:1.

* * * * *